US005592182A

United States Patent [19]

Yao et al.

[11] Patent Number: 5,592,182

[45] Date of Patent: Jan. 7, 1997

[54] EFFICIENT, DUAL-POLARIZATION, THREE-DIMENSIONALLY OMNI-DIRECTIONAL CROSSED-LOOP ANTENNA WITH A PLANAR BASE ELEMENT

[75] Inventors: Nian J. Yao, Mountain View; Vikram Verma, Palo Alto, both of Calif.

[73] Assignee: Texas Instruments Incorporated, Dallas, Tex.

[21] Appl. No.: 500,415

[22] Filed: Jul. 10, 1995

[51] Int. Cl.[6] ..... H01Q 11/12

[52] U.S. Cl. ..... 343/742; 343/797; 343/855; 343/860; 343/867

[58] Field of Search ..... 343/742, 797, 343/788, 855, 866, 867, 870, 860; H01Q 11/12, 21/24, 21/26

[56] References Cited

U.S. PATENT DOCUMENTS

| | | | |
|---|---|---|---|
| 3,440,542 | 4/1969 | Gautney . | |
| 3,560,983 | 2/1971 | Willie et al. . | |
| 3,680,135 | 7/1972 | Boyer | 343/742 |
| 3,683,389 | 8/1972 | Hollis | 343/742 X |
| 3,721,989 | 3/1973 | Christensen | 343/788 X |
| 3,945,013 | 3/1976 | Brunner et al. . | |
| 4,479,127 | 10/1984 | Barbano . | |
| 4,814,777 | 3/1989 | Caci et al. . | |
| 5,173,715 | 12/1992 | Rodal et al. | 343/797 X |
| 5,521,610 | 5/1996 | Rodal | 343/797 |

*Primary Examiner*—Hoanganh T. Le
*Assistant Examiner*—Tho Phan
*Attorney, Agent, or Firm*—Robert C. Klinger; James C. Kesterson; Richard L. Donaldson

[57] ABSTRACT

A self-contained system containing an antenna, a circuit board, and a power source. The antenna consists of two loop elements mounted perpendicular to each other on a circular metal plate that acts both as part of the radiating system and as a shield between the circuitry and the radiator. The circuit board includes a transmitter, a receiver, and other circuitry for storing information and executing software. The antenna has a high gain, is omnidirectional in two orthogonal polarizations, and has a high degree of isolation between the two loop elements. To achieve omnidirectionality, in one mode, the antenna operates by using each loop element in a time-sequence of brief on/off states. In another mode, the transceiver uses both loop elements simultaneously with the signals on the two loop elements in phase quadrature.

33 Claims, 4 Drawing Sheets

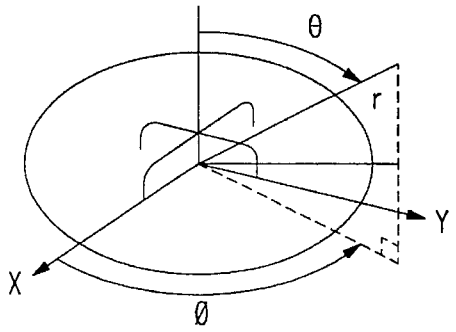
Fig. 4a
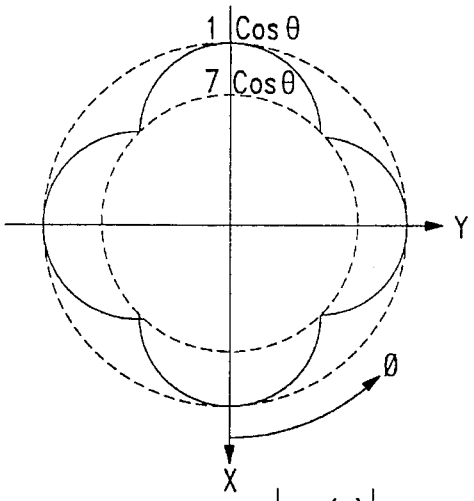
HORIZONTAL $|rE_{\emptyset}(\emptyset)|$
Fig. 4b(1)
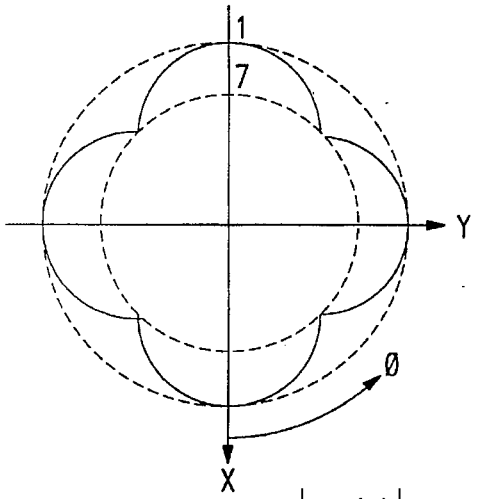
LOCALLY VERTICAL $|rE_{\emptyset}(\emptyset)|$
Fig. 4b(2)
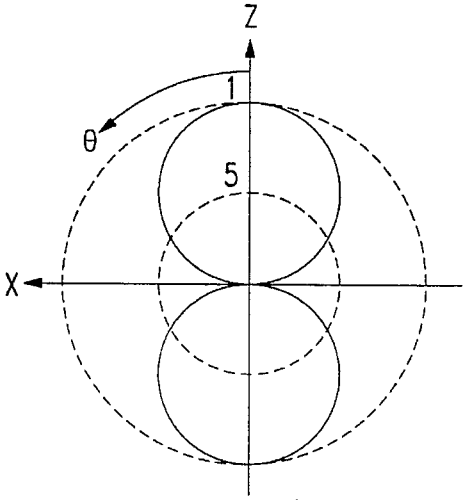
HORIZONTAL $|rE_{\emptyset}(\theta)|$
Fig. 4c(1)
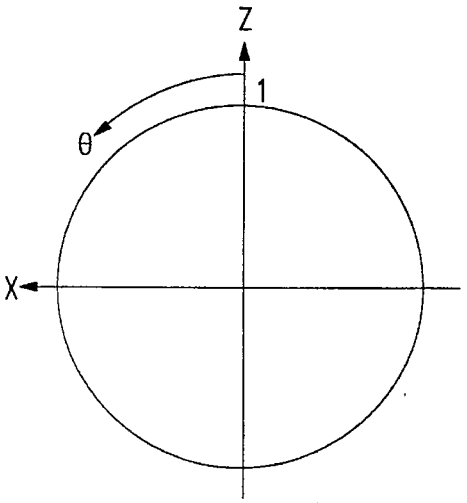
LOCALLY VERTICAL $|rE_{\emptyset}(\theta)|$
Fig. 4c(2)

EFFICIENT, DUAL-POLARIZATION, THREE-DIMENSIONALLY OMNI-DIRECTIONAL CROSSED-LOOP ANTENNA WITH A PLANAR BASE ELEMENT

BACKGROUND OF THE INVENTION

This invention relates generally to a compact, high-efficiency, electrically small loop antennas for use in both transmitters and receivers of portable communication devices.

The physical size of modem compact communication devices (such as radio tags, personal communicators and pagers) often are dictated by the size of the antenna needed to make them function effectively. To avoid devices that are too large, pagers have made use of electrically small rectangular loop antennas as receive-only antennas with the maximum dimension of any antenna elements that constitute the antenna on the order of one-tenth of a wavelength or less of the receiving frequency. However, these small antennas tend to be inefficient as a result of their very low radiation resistance and comparatively high resistive loss. Likewise, as a result of their high inductive reactance (or Q) they tend to be sensitive to their physical environment. These small antennas have been known to cause parasitic oscillations in attached radio frequency (RF) circuitry. Finally, because of their low efficiency, these small antennas are inadequate as transmitter antennas.

To overcome the disadvantages of electrically small loop antennas, there is continuing need for antennas small in physical dimension (each element less than one-tenth of a wavelength, for example); having relatively high efficiency; capable of being placed in close proximity to associated electronic circuits without adversely affecting performance; capable of being used effectively for both transmitting and receiving; relatively insensitive to orientation and surroundings; easy to manufacture using standard, low-cost components; and capable of having radiation patterns altered to support different applications.

There is a need for antennas in general and in particular for efficient, dual-polarization, and three-dimensionally omnidirectional antennas that operate at VHF or UHF frequencies.

Such antennas are useful for general telecommunications applications. A particular need for such antennas exists in electronic inventory and tracking systems as an interrogator of radio tags attached to various remotely located items such as boxes or vehicles within a given area such as a warehouse or a parking lot. In such an application, a need exists for a relatively compact, structurally robust antenna that can satisfy the following conditions:

(1) Is tunable at high frequencies (specifically 315 and 433 MHz).

(2) Operates efficiently enough to communicate with other antennas as far away as three-hundred feet while meeting the FCC limitations on maximum radiated power.

(3) Is capable of communicating with antennas with unknown orientations and hence unknown polarization responses.

(4) Where an array of two antenna elements is employed, minimal coupling between the antenna elements so that there is minimal signal distortion passed on to the receiver circuitry.

The term "omnidirectional" as used to describe antenna performance had various meanings in the literature. The term "omnidirectional" is often used when the radiation pattern of the antenna is constant in a single plane and usually only refers to the radiation pattern for a single polarization. The typical examples of this class of omnidirectional antennas are the short dipole and the small loop antenna. For example, U.S. Pat. Nos. 3,560,983 and 4,479,127 describe electrically small loop antennas with this type of omnidirectionality. However, that type of two-dimensional, single-polarization omnidirectionality is not sufficient for many purposes. When the antennas are not coplanar and the orientations of the other antennas are unknown, it is necessary to have a broader type of omnidirectionality.

Typically an army of two or more antenna elements with complementary polarization responses and complementary radiation patterns operating simultaneously gives greater omnidirectionality. For example, U.S. Pat. No. 4,814,777 describes an array of vertical monopole antennas and horizontal dipole antennas arranged on alternating coplanar and concentric circles. U.S. Pat. No. 3,945,013 describes an array consisting of a vertical monopole antenna and a slot antenna sensitive to horizontal polarization. In using antennas of these types it has been found first, that to achieve the required efficiency, the monopoles were too long to be structurally robust, and second, that to achieve the desired gain for a slot antenna resulted in low efficiency due to dielectric losses in the plastic material filling the slot even though such material provides greater structural robustness. Hence these types of designs have been found unsatisfactory.

U.S. Pat. Nos. 3,440,542 and 3,721,989 describe crossed loop antenna arrays consisting of multiple windings around ferrite cores. These antennas operate at 535–1650 kHz and 10–14 kHz respectively. These antennas are more compact and structurally more robust than antennas that use monopoles. Although those antennas are described as "omnidirectional", the omnidirectionality is for a single polarization, the vertical polarization, in the plane containing the ferrite cores. In other words, they have the same type of limited omnidirectionality mentioned above. In the plane of the ferrite cores (the omnidirectionality for the vertical polarization) the horizontal polarization radiation pattern has a null. Another shortcoming is that these antennas are inefficient for use at UHF frequencies. These antennas have a very large inductance due to the large number of turns of wire and to the high permeability of the ferrite cores. Tuning these antennas at UHF frequencies requires an impractically small capacitance (about 0.3–0.6 milli-pico-farads). Also, although not explicitly discussed these antennas are very inefficient in that they have high loss resistance relative to their radiation resistance and hence have very low gain. Typical gains for small loop antennas are on the order of about −20 dB. Furthermore, the use of ferrite cores at UHF frequencies would increase the loss resistance and hence decrease the efficiency prohibitively.

In the above-identified application entitled EFFICIENT ELECTRICALLY SMALL LOOP ANTENNA WITH A PLANAR BASE ELEMENT, an electrically small rectangular loop antenna is mounted on a rectangular, metal base plate. In that application, the base plate was planar base element that formed part of the radiating system and also acted as a shield between the circuitry and the radiator. That application included a new design for a capacitive matching network contained in windows in the metal plate. In that application, frequencies were used such that the overall dimensions of the radiator were of the order of $\lambda/10$ where λ is the wavelength of the radiation. Thus, the radiation pattern tended to have the limited single polarization, two-dimensional omnidirectionality mentioned above.

SUMMARY OF THE INVENTION

The preferred embodiment of the invention described in the following paragraphs is part of a serf-contained system containing the antenna, a circuit board, and a power source. The antenna consists of two loop elements mounted perpendicular to each other on a circular metal plate that acts both as part of the radiating system and as a shield between the circuitry and the radiator. The circuit board includes a transmitter, a receiver, and other circuitry for storing information and executing software.

The antenna consisting of the two loop elements and the circular metal plate has the following performance capabilities: (1) It has a gain of 0 to 2 dBd (decibels with reference to a gain of 1.6, that is, of a lossless, half-wavelength dipole antenna) depending on the frequency. (2) It is omnidirectional in two orthogonal polarizations; that is, the radiation pattern of the antenna is highly isotropic in three dimensions (constant in amplitude over a broad range of directions) for two orthogonal polarizations. (3) It has a high degree of isolation between the two loop elements; that is, the response of the two loop elements in the antenna is highly decoupled to a level of at least −20 dB decoupling.

In order to achieve omnidirectionality, the antenna operates by using each loop element in a time-sequence of brief on/off states. In this way the transceiver uses only one of the loop elements at any instant. Because the radiation patterns of the two loop antennas are complementary, that is, the null of one loop's radiation pattern lies in the peak of the other's radiation pattern, the result is that almost all locations will receive essentially equal signals from the antenna, although not simultaneously. It is also possible to operate the antenna in another mode in which the transceiver uses both loop elements simultaneously with the signals on the two loop elements in phase quadrature (the signals are ninety ° out of phase with each other). The above facts about the radiation pattern also apply to this mode of operation except that all antennas at all locations can communicate with the crossed-loop antenna simultaneously. A unique feature of this phase quadrature mode of operation, that may be desirable for some applications, is that the radiated field is circularly polarized whereas the field is linearly polarized in the one loop element at a time mode of operation.

The preferred embodiment of the invention consists of two rectangular loops mounted vertically on top of a circular metal base plate (see FIGS. 1, 2, and 3). Each rectangular loop is made by bending a copper tube into three sides of a rectangle that form two short sections extending vertically from the base plate and a long horizontal section between the vertical sections. The base plate completes the circuit for the current that flows in both of the rectangular loops. The two loops connect to the base plate so that the plane containing one loop is perpendicular to the plane of the other loop. One of the loops has slightly taller vertical sections than the other loop so that the horizontal section of the second loop may pass under the horizontal section of the first without making contact.

The base plate is a thin circular disk of copper sheet metal attached to a relatively thicker circular disk of plastic material. The plastic backing provides mechanical strength and has minimal electrical effects due to its extreme thinness compared to the wavelength. The base plate acts both as a radiator and a shield for the circuitry. The base plate acts as a radiator because the resonant current that flows through the loops also flows through the base plate. The base plate in effect enhances the radiating area of the loops and hence the radiation resistance because it forms an image of the loops (the image is imperfect due to the finite size of the base plate, so the effective area increases by a factor between unity and the limiting value of two).

The base plate acts as a shield because its thickness is approximately ten times the skin depth at the operating frequency so that virtually none of the resonant current penetrates from the top surface to the bottom surface. Furthermore, the majority of the current that flows on the base plate naturally flows in a region directly below the horizontal sections of the two rectangular loops and hence very little current can flow around the metal disc's edge onto the bottom surface of the disk. This natural tendency is further enhanced by positioning the capacitors within the windows (to be discussed next) in a manner that forces the currents to start out from one leg of one of the loops in the direction toward the other leg of the same loop, that is, in the direction parallel to the horizontal section of the loop.

Capacitors for tuning the frequency response of the antenna and structures for the voltage feed reside in four rectangular windows cut out of the metal base plate at the locations where the vertical sections of the loops meet the plane of the metal plate. The rectangular windows form two pairs, one for each of the loop elements. In each pair one rectangular window is larger than the other one. The two larger windows are similar in shape and size and the two smaller windows are similar in shape and size. The plastic backing of the base plate is exposed in the rectangular windows. Each loop's vertical leg connects to a small rectangular metal island inside the rectangular windows.

The larger rectangular windows contain a specially shaped metal strip that connects to a feed point at one end, to the metal island on which one leg of each half-loop connects through an adjustable-capacitance impedance element at another point, and to the base plate through constant-capacitance impedance elements at yet another point. Electrically speaking, the adjustable-capacitance impedance elements are in series with the loop as well as the voltage source. The constant-capacitance impedance elements are electrically in series with the loop, but parallel to the voltage source.

The smaller rectangular windows contain a small rectangular strip of metal that serves as a structure on which to solder two constant-capacitance impedance elements. One of the capacitors connects from the metal island on which one leg of each half-loop connects to the metal strip and the other capacitor connects from the metal strip to the base plate. Electrically, the two capacitors and the metal strip are in series with each other and the loop.

1 showing the variation of the amplitude of two orthogonal components of the electric field, E, with respect to location in space.

FIG. 4*a* shows the geometry and a spherical coordinate system (r,θ,ϕ) that is convenient for depicting the radiation pattern.

FIG. 4*b* shows the horizontal, $E_\phi$, and locally vertical, $E_\theta$, polarization patterns with respect to variation in azimuthal angle, ϕ; that is, in a plane of constant z=r cos θ.

FIG. 4*c* shows the horizontal and locally vertical polarization patterns with respect to variations in polar angle, θ; that is, in a plane of constant ϕ.

Figure 5:
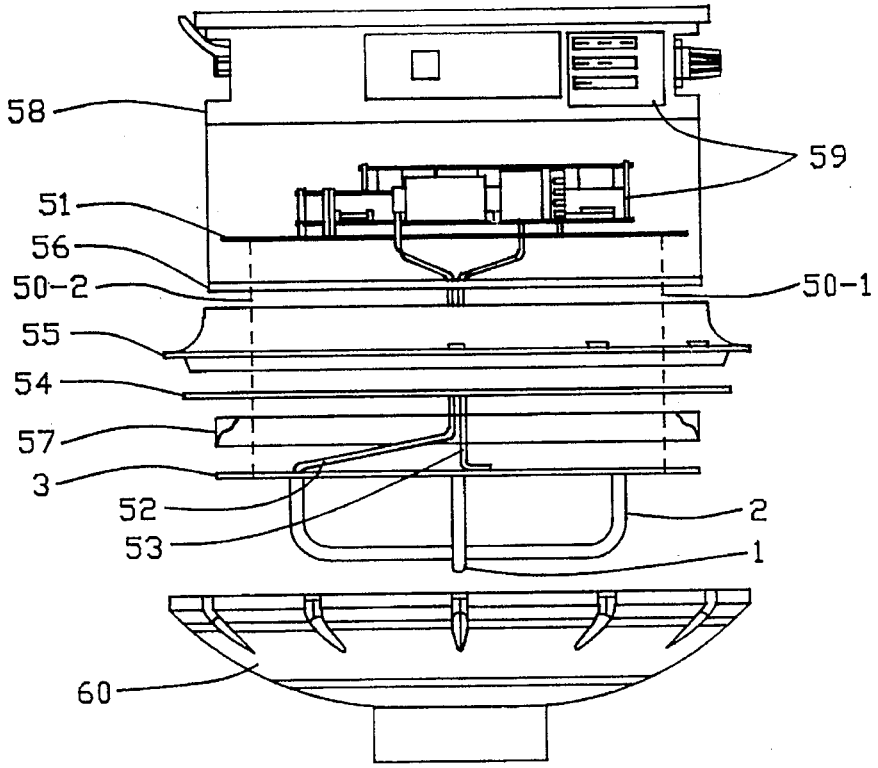

FIG. 5 depicts an assembly drawing of a transceiver including an antenna and an electrical circuit assembled in a housing.

DETAILED DESCRIPTION

Figure 1:
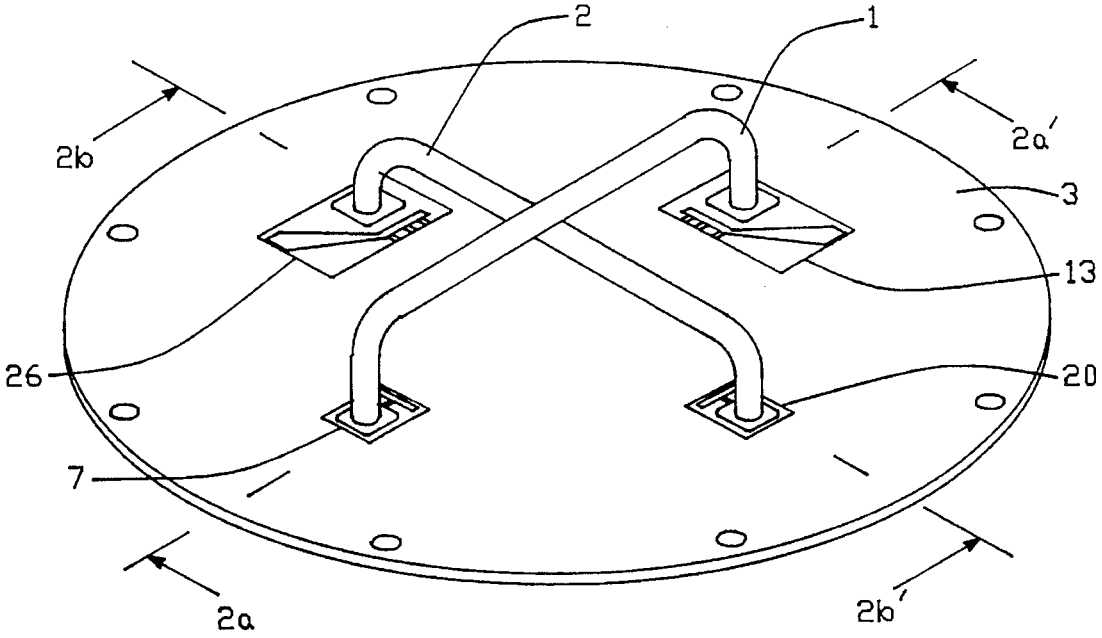
FIG. 1 shows an isometric view of a crossed-loop antenna and a metal base plate.

FIG. 1 shows a crossed-loop antenna which is a radiation device including a first conductive loop 1, a second conductive loop 2 and a conductive planar base element 3 Each of the loops 1 and 2 is analogous to the conductive loop in the above-identified cross-referenced application entitled *Efficient Electrically Small Loop Antenna with a Planar Base Element.* The planar base element 3 includes rectangular windows 7, 13, 20, and 26.

Figure 2A:
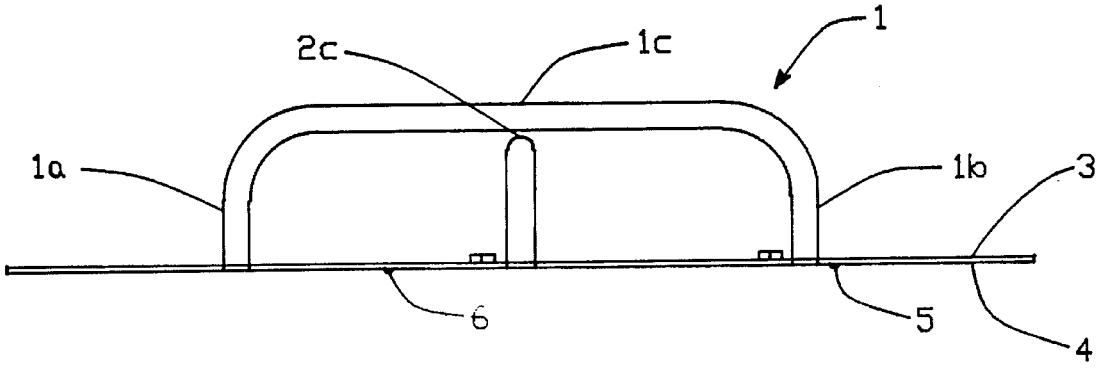
FIG. 2*a* shows a side view of the FIG. 1 embodiment of a crossed-loop antenna with a view from a direction orthogonal to the taller of the two crossed loops.
Figure 2B:
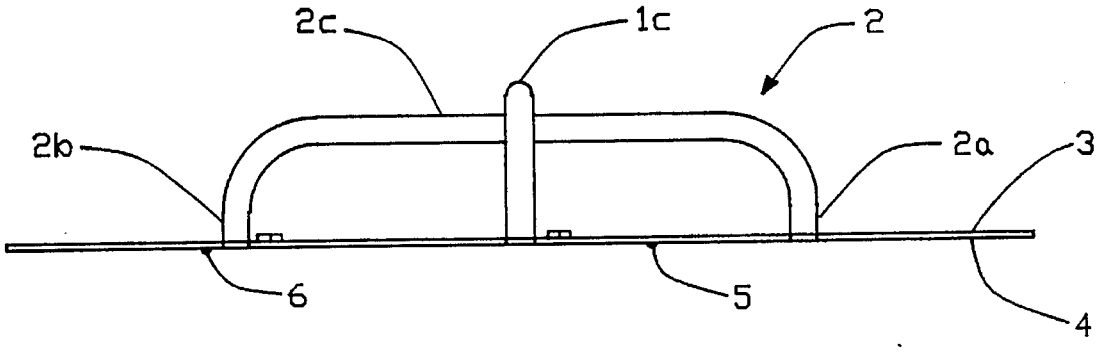
FIG. 2*b* shows a side view of the FIG. 1 embodiment of a crossed-loop antenna with a view from a direction orthogonal to the shorter of the two crossed loops.

FIGS. 2*a* and 2*b* show two different side views of the FIG. 1 antenna. FIG. 2*a* is a view from the direction perpendicular to the plane of the taller loop 1. FIG. 2*b* is a view from the direction perpendicular to the plane of the shorter loop 2. Loop 1 includes (with reference to the planar base element 3) two vertical elements 1(*a*) and 1(*b*) and a horizontal element 1(*c*). The vertical elements 1(*a*) and 1(*b*) are more or less perpendicular to the plane of a circular, copper base plate of planar base element 3. Loop 2 includes (with reference to planar base dement 3) two vertical elements 2(*a*) and 2(*b*) and a horizontal element 2(*c*). Each of the two loop 1 and 2 is typically formed from a single copper tube of circular cross section by bending it into three sides of a rectangle with slightly rounded comers. The planar base element 3 is formed of a circular, copper layer formed on a thin circular plastic board 4. In the embodiment shown, the plastic board 4 is made from conventional printed circuit board material. Two feed nodes 5 and 6 run perpendicular to the plane of the planar base element 3 and connect to the base element 3 via a hole through the plastic board 4.

In the preferred embodiments, for 315 MHz and 433 MHz operation, the planar base element 3 is 248 mm in diameter. The combination of the copper plate and the plastic backing material for planar base element 3 is 1.7 mm thick. In the 433 MHz embodiment, the taller loop 1 stands 37 mm above the base plate as measured at the midpoint of element 1(*c*) (all measurements referring to the copper tubes forming the two loops 1 and 2 are measured at the center of the tube). The distance between the attachment points on the base plate of the vertical elements 1(*a*) and 1(*b*) is 142 mm. Also, in the 433 MHz embodiment the shorter loop 2 stands 29 mm above the planar base element 3 and the distance between the vertical elements 2(*a*) and 2(*b*) is 142 mm. In the 315 MHz embodiment, the taller loop 1 stands 40 mm above the planar base element and the distance between the vertical elements 1(*a*) and 1(*b*) is 187 mm. Also, in the 315 MHz embodiment, the shorter loop 2 stands 31 mm above the planar base element 3 and the distance between the vertical elements 2(*a*) and 2(*b*) is 187 mm. In both the 315 MHz and the 433 Mhz embodiments, the copper tube is 6 mm in diameter.

Figure 3:
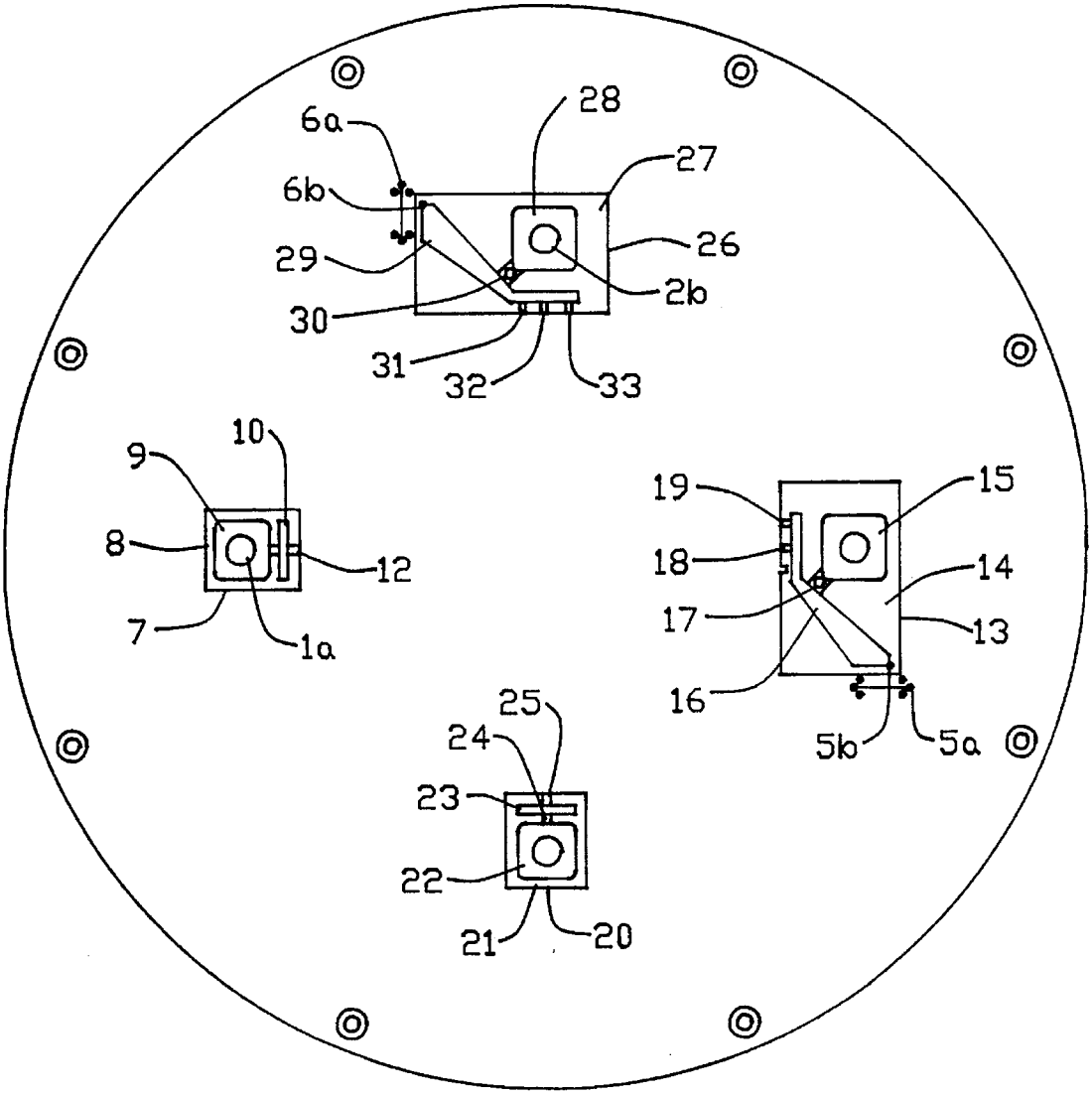
FIG. 3 shows a top sectional view of the FIG. 1 embodiment. 4*c* show the radiation pattern of the antenna of FIG.

FIG. 3 shows a top view of the circular, copper-clad planar base element 3. In FIG. 3, four rectangular windows 7, 13, 20, and 26 are cut out of the copper plate of the planar base element 3. Each of the rectangular windows exposes the plastic board 4. These exposed parts of the plastic board 4 are labeled 8, 14, 21, and 27 in FIG. 3. Metallic traces, or metal "islands", etched on the plastic in each of these windows provide convenient locations for soldering capacitors. The feed nodes 5 and 6 are near windows 13 and 26. Each feed node splits into two nodes 5(*a*) and 5(*b*) and 6(*a*) and 6(*b*). Each node connects to the metal of base element 3 or to a metal island inside the rectangular windows through holes in the plastic board Rectangular window 7 exposes dielectric material 8 from the plastic board 4. Element 1(*a*) of loop 1 connects to a rectangular metal trace or island 9 inside rectangular window 7. Another rectangular trace or island 10 also inside rectangular window 7 serves as a point to solder capacitors 11 and 12. Capacitor 11 connects from metal island 9 to metal island 10 and capacitor 12 connects from metal island 10 to the copper base plate 3.

Rectangular window 13 exposes dielectric material 14 from the plastic board 4. Element 1(*b*) connects to metal island 15 inside rectangular window 13. There is another metal trace or island 16 inside rectangular window 13. One side 5(*b*) of feed node 5 is at one end of metal island 16 near the other side 5(*a*) of feed node 5. In either transmit or receive mode, a potential difference appears between nodes 5(*a*) and 5(*b*). A variable capacitor 17 connects from metal island 15 to metal island 16. Capacitors 18 and 19 are parallel to each other and they connect from metal island 16 to the copper plate of planar base element 3.

Rectangular window 20 exposes dielectric material 21 from the plastic board 4. Leg 2(*a*) of loop antenna 2 connects to a rectangular metal trace or island 22 inside rectangular window 20. Another rectangular trace or island 23 also inside rectangular window 20 serves as a point to solder capacitors 24 and 25. Capacitor 24 connects from metal island 22 to metal island 23 and capacitor 25 connects from metal island 23 to the copper base plate 3.

Rectangular window 26 exposes dielectric material 27 from the plastic board 4. Element 2(*b*) connects to metal island 28 inside rectangular window 26. Them is another metal trace or island 29 inside rectangular window 26. One side 6(*b*) of feed node 6 is at one end of metal island 29 near the other side 6(*a*) of feed node 6. In either transmit or receive mode, a potential difference appears between nodes 6(*a*) and 6(*b*). A variable capacitor 30 connects from metal island 28 to metal island 29. Capacitors 31, 32, and 33 are parallel to each other and they connect from metal island 29 to the copper plate of planar base element 3.

FIG. 4 shows the radiation pattern of the antenna for two orthogonal polarizations of the electric field, E, when the antenna operates in the one loop element at a time mode of operation. The radiation pattern shown here is the complementary pattern assuming that the test antenna records the maximum of the electric field received from the two loops 1 radiating at different times. FIG. 4*a* defines a spherical coordinate system with radial coordinate, r, polar angle (or colatitude), θ, and azimuth angle (or longitude), ϕ. In any particular direction, the most convenient components of the electric field to use for this discussion are the $E_\theta$ and $E_\phi$ components. The $E_\phi$ component is called the horizontal component and the $E_\theta$ is called component the "locally vertical component". FIG. 4*b* shows the radiation patterns for the horizontal and the locally vertical polarizations in a plane defined by the equation z=r cos θ=constant as functions of azimuth angle, ϕ. The horizontal polarization at any location is proportional to cos θ. Thus, the horizontal polarization radiation pattern is not strictly omnidirectional; there is a null in the horizontal polarization radiation pattern in the z=0 plane. However, for angles between θ=0° to θ=60° and between θ=120° to θ=180° (a region coveting haft of the total sphere at any given radius), the horizontal polarization amplitude is within 3 dB of its peak value at θ=0°. FIG. 4*c* shows the radiation patterns for the horizontal and the locally vertical polarizations measured in the y=0 plane as functions of polar angle, θ. These patterns exhibit dual-polarization omnidirectionality within a tolerance of about 3 dB over a broad range of directions.

Transceiver Assembly—FIG. 5

FIG. 5 depicts an assembly drawing of a transceiver including an antenna and an electrical circuit assembled in a housing. In FIG. 5, planar base element 3 and the first loop 1 and second loop 2 are assembled within the housing including the elements 55, 57, 58 and 60. The housing also includes spacers 54, 55, 56 and 57. The electrical circuitry 59 is mounted on a ground plane 51. The ground plane includes a first connection 50-1 and a second connection 50-2 to the planar base element 3 by the connectors 50-1 and 50-2. As can be seen in FIG. 5, the electrical circuitry 59 is spaced apart from the antenna formed of loops 1 and 2 and the planar base element 3 both by the planar base element 3 which is on one side of the loop 2 and 3 and by the electrical circuit ground plane 51. This structure in FIG. 5 establishes the isolation of the electrical circuitry 59 from the radiation device formed of elements 1, 2 and 3. The radiation loops 1 and 2 are connected by conductors 52 and 53 to the electrical circuit 59 which together with the first and second conductor 50-1 and 50-2 complete the conduction path between the electrical circuit 59 and the radiation device.

We claim:

1. An electrically small loop antenna for connection to an electrical circuit for operation at a radiation frequency, said antenna comprising, a radiation device conducting a resonant current for radiation at the radiation frequency, said radiation device including, a conductive planar base element extending in a base plane for conducting said resonant current for radiation at the radiation frequency, a conductive first loop extending from a first-loop first end to a first-loop second end for conducting a first component of said resonant current for radiation at the radiation frequency, a conductive second loop extending from a second-loop first end to a second-loop second end for conducting a second component of said resonant current for radiation at the radiation frequency, said first-loop first end for connection to said base element at a first-loop first location and said first-loop second end for connection to said base element at a first-loop second location spaced from said first-loop first location to enable said first component of said resonant current to conduct through the conductive planar base element and the conductive first loop, said second-loop first end for connection to said base element at a second-loop first location and said second-loop second end for connection to said base element at a second-loop second location spaced from said second-loop first location to enable said second component of said resonant current to conduct through the conductive planar base element and the conductive second loop, a first matching network for matching the impedance of the conductive planar base element and the first loop to the impedance of the electrical circuit, said first matching network connecting the first-loop second end of the conductive first loop to the base element at the first-loop second location to form a first resonant circuit loop having a high Q, said first resonant circuit loop including said conductive planar base element and said conductive first loop whereby said first component of the resonant current is conducted through the base element and through the conductive first loop, a second matching network for matching the impedance of the conductive planar base element and the second loop to the impedance of the electrical circuit, said second matching network connecting the second-loop second end of the conductive second loop to the base element at the second-loop second location to form a second resonant circuit loop having a high Q, said second resonant circuit loop including said conductive planar base element and said conductive second loop whereby said second component of the resonant current is conducted through the base element and through the conductive second loop, first and second connector means, each having first and second conductors for connecting to the electrical circuit, one of said conductors for each of said first and second connector means connected directly to said base element and the other of said conductors connected respectively one of said matching networks whereby electrical current is conducted between the electrical circuit and the radiation device.

2. The antenna of claim 1 wherein said planar base element is formed as a conductive sheet.

3. The antenna of claim 1 wherein said planar base element is formed as a conductive metal cladding on a dielectric material.

4. The antenna of claim 1 wherein said conductive first and second loops lie in first and second loop planes, each substantially perpendicular to said base plane.

5. The antenna of claim 1 wherein said conductive first and second loops lie in first and second loop planes substantially perpendicular to said base plane and wherein portions of the first and second components of said resonant current in said base element are distributed outside said first and second loop planes, respectively.

6. The antenna of claim 1 wherein said base plane includes non-conductive windows and wherein said first and second matching networks include capacitors in said windows connected between said base element and the first and second loop elements, respectively, for conducting said first and second components of said resonant current, respectively.

7. A communication transceiver comprising, an electrical circuit mounted on a circuit board for operation at a radiation frequency, an electrically small loop antenna including, a radiation device including, a conductive planar base element extending in a base plane, a conductive first loop extending from a first-loop first end to a first-loop second end, said first-loop first end of the conductive first loop for connection to said base element at a first-loop first location and said first-loop second end of the conductive first loop for connection to said base element at a first-loop second location spaced from said first-loop first location, a conductive second loop extending from a second-loop first end to a second-loop second end, said second-loop first end of the conductive second loop for connection to said base element at a second-loop first location and said second-loop second end of the conductive second loop for connection to said base element at a second-loop second location spaced from said second-loop first location, a first matching network for matching the impedance of the radiation device to the impedance of the electrical circuit, said first matching network connecting the first-loop second end of the conductive first loop to the base element at the first-loop second location whereby a first component of said radiation current is conducted through the base element and the conductive first loop, a second matching network for matching the impedance of the radiation device to the impedance of the electrical circuit, said second matching network connecting the second-loop second end of the conductive second loop to the base element at the second-loop second location whereby a second component of said radiation current is conducted through the base element and the conductive second loop, connector means having first and second conductors for connecting to the electrical circuit, one of said conductors connected to said base element and the other of said conductors connected to the matching network whereby a connector current is conducted between the antenna and the electrical circuit, a housing including, means for engaging and locating the circuit board having the electrical circuit at a first level, means for engaging and locating the base element of the radiation device at a second level parallel to and offset from the first level whereby the base element is positioned in a plane offset from the electrical circuit to isolate the electrical circuit from the conductive loop of the radiation device.

8. Communication device embodying the antenna of claim 7 wherein said planar base element is formed as a conductive sheet on a high-loss dielectric material.

9. The antenna of claim 7 wherein said planar base element is formed as a conductive sheet on a low-loss dielectric material.

10. The antenna of claim 7 wherein said conductive loop lies in a loop plane substantially perpendicular to said base plane.

11. The antenna of claim 7 wherein said conductive loop lies in a loop plane substantially perpendicular to said base plane and wherein a portion of the radiation current in said base element is distributed outside said loop plane.

12. The antenna of claim 7 wherein said conductive loop lies in a loop plane substantially perpendicular to said base plane, wherein a portion of the resonant current in said base element is distributed outside said loop plane, and wherein a substantially greater portion of the radiation current in said base element is located on one side of said loop plane whereby the antenna radiation pattern tends to be omnidirectional.

13. The antenna of claim 7 wherein said base plane includes a non-conductive window and wherein said matching network includes a capacitor in said window connected to said base element.

14. The antenna of claim 7 wherein said base plane includes a plurality of non-conductive windows and wherein said matching network includes a first capacitor in one of said windows connected to said base element and wherein another of said windows includes a second capacitor connected to said base element whereby the first and second capacitors are connected in series.

15. The antenna of claim 7 wherein said base plane includes a non-conductive window and wherein said matching network includes, in said window, strip conductors and capacitors connecting the base element to the conductive loop.

16. The antenna of claim 7 wherein said conductive loop lies in a loop plane substantially perpendicular to said base plane and wherein said antenna includes means for controlling the direction of the radiation current in said base element to control the antenna directionality.

17. The antenna of claim 7 wherein said base plane includes a non-conductive window and wherein said matching network includes an inductor in said window connected to said base element.

18. The antenna of claim 17 wherein the inductor is a tapped transformer.

19. The antenna of claim 18 wherein said transformer includes a strip conductor and a sliding tap for making a tap connection to said strip conductor whereby the impedance transformation ratio of the transformer is changeable for tuning the antenna.

20. The antenna of claim 7 wherein said conductive loop lies in a loop plane substantially perpendicular to said base plane, wherein said base plane includes a non-conductive window, and wherein said matching network is formed with a plurality of capacitors located in said window and connected to said base element at a plurality of different capacitor locations distributed in the base plane whereby the radiation current in said base element tends to be distributed in said base plane.

21. The antenna of claim 20 wherein said capacitors located in said window are positioned in close proximity to said loop plane whereby the length of the conduction path for the radiation current in the radiation device is minimized.

22. The antenna of claim 20 wherein said capacitors are constructed with high-loss material.

23. The antenna of claim 20 wherein said capacitors are constructed with low-loss material.

24. The antenna of claim 7 wherein said conductive loop includes first and second loop elements substantially perpendicular to said base plane and a third loop element substantially parallel to said base plane.

25. The antenna of claim 24 wherein said first, second and third loop elements are circular in cross-section, having a surface area small compared to the surface area of said base element in the base plane.

26. A crossed-loop antenna with a planar base element comprising, a conductive planar base element with a top side and a bottom side, a first conductive loop portion with first and second ends connected on said top side of said planar base element, a second conductive loop portion with first and second ends also connected on said top side of said planar base element, said first and second conductive loop portions lying in two intersecting planes that are each substantially perpendicular to the plane of said planar base element and also perpendicular to each other, electrical networks interconnecting each end of said loop portions and the base element for the purposes of combining with the antenna impedance to produce a resonant current and for matching the impedance of the loop antennas to an electrical circuit, connector means having a first and second pair of conductors for connecting to the antenna and extending through said bottom side of said base plane to an electrical circuit, said first pair of conductors for connecting to said first loop portion and to said base element and said second pair of conductors for connecting to said second loop portion and said base element.

27. The antenna of claim 26 wherein said ends of said loop portions and said electrical networks are placed on said base plane within non-conducting windows cut out of said conducting base element.

28. The antenna of claim 27 wherein said networks are formed from a plurality of capacitors and conductive strips placed inside said non-conducting windows.

29. The antenna of claim 28 wherein said networks connected to the second end of each loop portion each consists of a first capacitor interconnecting the second end of each loop to a metal strip and a second capacitor interconnecting said metal strip and the base element, and wherein said networks connected to said first ends of each loop portion each consists of a capacitor with adjustable capacitance value interconnecting the first end of each loop and a metal strip and a plurality of capacitors connected in parallel interconnecting the metal strip and the base element, said metal strip having an elongated shape one end of which connect to one conductor of said connector means.

30. The antenna of claim 29 wherein said first pair of connector conductors has a first conductor that connects directly to the base element at a location near the first end of the first loop portion and a second conductor that connects to the electrical network connected to the first end of the first loop portion, and also said second pair of connector conductors has a first conductor that connects directly to the base element at a location near the first end of the second loop portion and a second conductor that connects to the capacitive network connected to the first end of the second loop portion.

31. The antenna of claim 26 wherein said loop portions are formed from conducting tubes each in the shape of three sides of a rectangle, said rectangle having first, second, and third sides, said first and second sides being of equal length and shorter than the third side, said first and second sides having open ends identical to said first and second ends of each loop portion, said loop portions placed in a symmetrical fashion on the base element such that the plane of the first loop portion cuts through the midpoint of the third side of the second loop portion, said first and second sides of said first loop portion being taller than first and second sides of said second loop portion so that the conductors do not touch.

32. The antenna of claim 26 wherein said base element has a circular shape and is formed from conductive cladding on a plastic sheet.

33. A communication device comprised of three separate levels of which the antenna of claim 26 is on one level, an electrical circuit containing a radio transceiver is on another level on the same side as said bottom side of said base element, and a third level containing a battery.

* * * * *